US010559435B2

(12) United States Patent
Kishi et al.

(10) Patent No.: US 10,559,435 B2
(45) Date of Patent: Feb. 11, 2020

(54) SWITCH

(71) Applicant: OMRON Corporation, Kyoto (JP)

(72) Inventors: Shigenobu Kishi, Shiga (JP); Yoshinori Ijiri, Okayama (JP); Mamiko Naka, Okayama (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 15/985,332

(22) Filed: May 21, 2018

(65) Prior Publication Data

US 2018/0374662 A1 Dec. 27, 2018

(30) Foreign Application Priority Data

Jun. 22, 2017 (JP) ..... 2017-122508

(51) Int. Cl.
*H01H 13/30* (2006.01)
*H01H 13/52* (2006.01)
(Continued)

(52) U.S. Cl.
CPC ..... *H01H 13/30* (2013.01); *H01H 1/42* (2013.01); *H01H 5/18* (2013.01); *H01H 13/42* (2013.01);
(Continued)

(58) Field of Classification Search
CPC ..... H01H 13/30; H01H 13/36; H01H 13/365; H01H 13/38; H01H 13/40; H01H 5/18; H01H 5/20; H01H 5/22
See application file for complete search history.

(56) References Cited

U.S. PATENT DOCUMENTS 3,030,466 A * 4/1962 Kryder ..... H01H 13/40 200/453
3,345,476 A * 10/1967 Russell ..... H01H 13/38 200/407
(Continued)

FOREIGN PATENT DOCUMENTS

CN 102576615 A 7/2012
CN 202796591 U 3/2013
(Continued)

OTHER PUBLICATIONS

Office Action issued in Chinese Application No. 201810425203.3, dated May 8, 2019 (19 pages).
(Continued)

*Primary Examiner* — Felix O Figueroa
(74) *Attorney, Agent, or Firm* — Osha Liang LLP

(57) ABSTRACT

A highly durable, quiet switch includes a housing, a stationary contact terminal including a fixed portion, a moving contact terminal, a moving contact unit including a body, a moving portion, and an urging member and connected to the moving contact terminal, an operating unit, a first elastic unit that comes in contact with the moving contact unit and elastically deforms when the moving portion moves away from the fixed portion, and a second elastic unit including a contact point between the moving portion and the fixed portion facing the moving portion to come in contact with the moving portion. The second elastic unit elastically deforms and electrically connects the stationary and moving contact terminals when the moving portion moves toward the fixed portion and comes in contact with the contact point.

6 Claims, 8 Drawing Sheets

(51) Int. Cl.

| | |
|---|---|
| ***H01H 1/42*** | (2006.01) |
| ***H01H 13/42*** | (2006.01) |
| ***H01H 5/18*** | (2006.01) |
| *H01H 1/18* | (2006.01) |
| *H01H 1/50* | (2006.01) |

(52) U.S. Cl.
CPC ..... *H01H 13/52* (2013.01); *H01H 1/18* (2013.01); *H01H 1/50* (2013.01); *H01H 2221/062* (2013.01)

(56) References Cited

U.S. PATENT DOCUMENTS

| | | | | |
|---|---|---|---|---|
| 6,998,555 | B2 * | 2/2006 | Collot | H01H 13/36 200/402 |
| 9,741,504 | B2 * | 8/2017 | Shiraishi | H01H 13/06 |
| 2012/0152714 | A1 | 6/2012 | Kishi et al. | |
| 2015/0008107 | A1 | 1/2015 | Takeuchi et al. | |
| 2015/0206670 | A1 | 7/2015 | Shiraishi | |

FOREIGN PATENT DOCUMENTS

| | | | |
|---|---|---|---|
| CN | 104282457 | A | 1/2015 |
| CN | 104603898 | A | 5/2015 |
| CN | 106328409 | A | 1/2017 |
| JP | H5-190071 | A | 7/1993 |
| JP | 2008-210654 | A | 9/2008 |

OTHER PUBLICATIONS

Office Action in counterpart Chinese Application No. 201810425203.3 dated Oct. 9, 2019 (14 pages).

* cited by examiner

SWITCH

FIELD

The prevent invention relates to a switch including a snap-action mechanism.

BACKGROUND

Patent Literature 1 describes a snap-action switch. This switch includes a common stationary terminal, a moving terminal including a moving contact and connected to the common stationary terminal, a normally-closed stationary terminal including a normally-closed contact normally connected to the moving contact, a normally-open stationary terminal including a normally-open contact connectable to the moving contact, and a coil spring that urges the moving terminal and can switch the urging direction.

In the switch, the normally-closed contact and the normally-open contact mutually slide on the moving contact to prevent a sound from being produced by the normally-closed contact or the normally-open contact colliding with the moving contact. The snap-action switch is thus quiet.

CITATION LIST

Patent Literature

Patent Literature 1: Japanese Unexamined Patent Application Publication No. 2008-210654

The above switch has the normally-closed contact and the normally-open contact mutually sliding on the moving contact. The switch may have severe wear of the normally-closed contact, the normally-open contact, and the moving contact, and may not achieve intended durability.

SUMMARY

One or more aspects of the present invention are directed to a switch that is highly durable and quiet.

A switch according to one or more aspects of the present invention includes a housing, a stationary contact terminal, a moving contact terminal, a moving contact unit, an operating unit, a first elastic unit, and a second elastic unit. The housing includes an internal compartment. The stationary contact terminal extends from outside the housing to the compartment and is fixed to the housing, and includes a fixed portion housed in the compartment. The moving contact terminal extends from outside the housing to the compartment, and is parallel to the stationary contact terminal. The moving contact terminal is fixed to the housing in a manner electrically independent of the stationary contact terminal. The moving contact unit is housed in the compartment, and includes a body, a moving portion, and an urging member. The body is connected to the moving contact terminal and extends from the moving contact terminal toward the stationary contact terminal. The moving portion is included in the body and faces the fixed portion and is movable toward and away from the fixed portion. The urging member is included in the body to urge the moving portion in an urging direction switchable between a closing direction for moving the moving portion toward the fixed portion and a separating direction for moving the moving portion away from the fixed portion. The operating unit is at least partly exposed outside the housing, and is at least partly housed in the compartment to come in contact with and reciprocate with respect to the moving contact unit. The operating unit switches the urging direction in accordance with reciprocation of the operating unit to move the moving portion toward or away from the fixed portion. The first elastic unit is fixed to the housing, and comes in contact with the moving contact unit and elastically deforms in the separating direction when the moving portion moves away from the fixed portion under an urging force of the urging member. The second elastic unit includes a contact point located between the moving portion and the fixed portion facing the moving portion in the closing direction and comes in contact with the moving portion. The second elastic unit is fixed to the stationary contact terminal or the moving contact terminal, and elastically deforms in the closing direction and electrically connects the stationary contact terminal and the moving contact terminal when the moving portion moves toward the fixed portion under the urging force of the urging member and comes in contact with the contact point.

The switch according to the above aspect includes the first elastic unit, which comes in contact with the moving contact unit and elastically deforms in the separating direction when the moving portion moves away from the fixed portion under the urging force of the urging member, and the second elastic unit, which elastically deforms in the closing direction and electrically connects the stationary contact terminal and the moving contact terminal when the moving portion moves toward the fixed portion under the urging force of the urging member and comes in contact with the contact point. This structure may reduce an impact applied when the moving portion comes in contact with the contact point of the second elastic unit in addition to an impact applied when the moving portion moves away from the contact point of the second elastic unit. This reduces sounds from such impacts applied when the moving portion moves toward or away from the fixed portion. The switch is thus quieter.

The moving portion faces the fixed portion and is movable toward and away from the fixed portion. The switch with this structure is more durable than a switch including a moving portion that slides on a fixed portion.

DETAILED DESCRIPTION

Embodiments of the present invention will now be described with reference to the accompanying drawings. The terms indicating specific directions or positions (e.g., up, down, right, left, end, side) used herein as appropriate are for easy understanding the embodiments of the invention with reference to the drawings, and do not limit the technical scope of the present invention. The embodiments described below are mere examples and do not limit the scope of the present invention and its applications or use. The drawings are schematic and are not drawn to scale but show only relative dimensions.

First Embodiment

Figure 1:
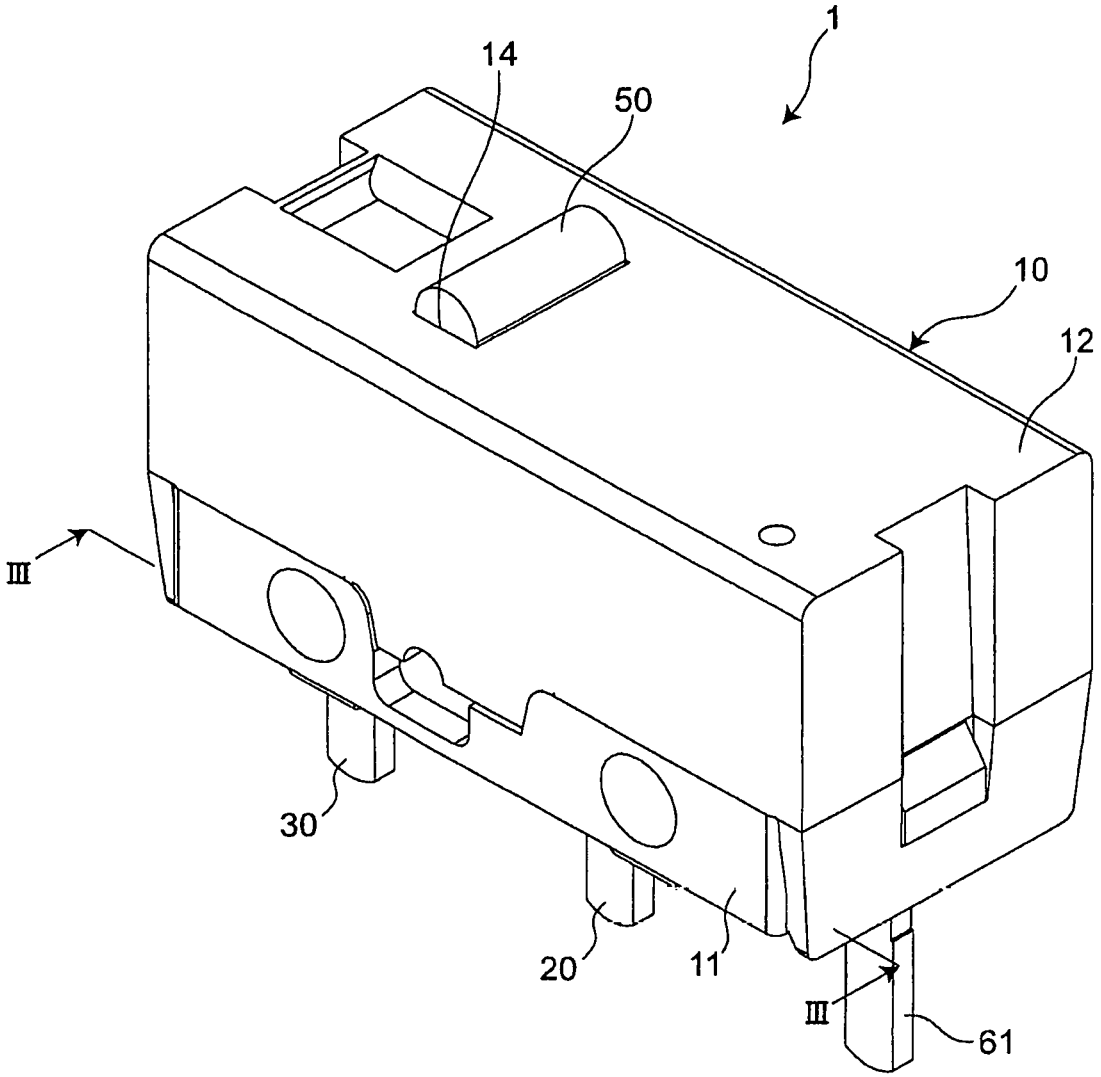
FIG. 1 is a perspective view of a switch according to one or more embodiments of the present invention.
Figure 2:
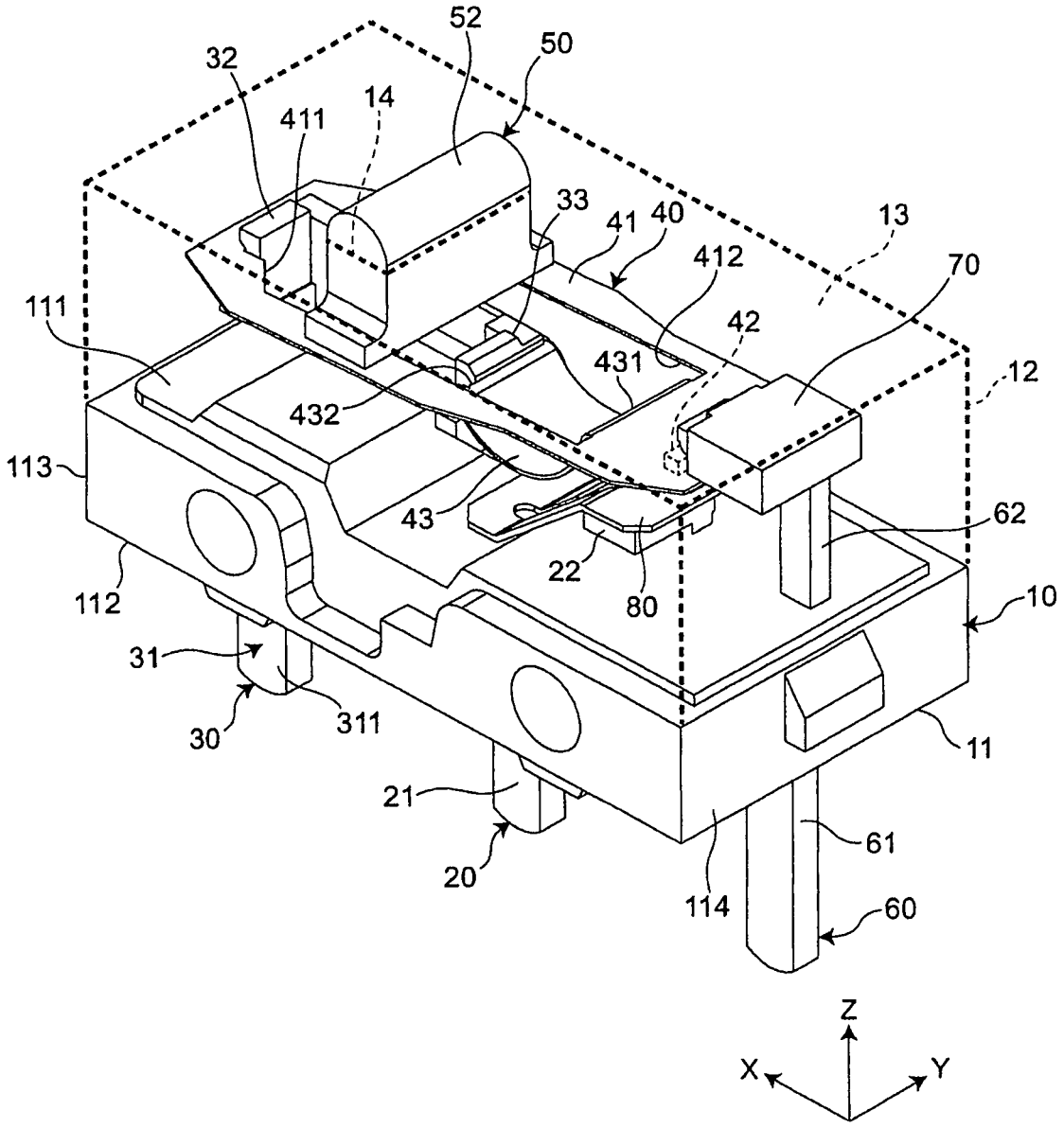
FIG. 2 is a perspective view of the switch shown in FIG. 1 with its cover removed.

As shown in FIG. 1, a switch 1 according to a first embodiment of the present invention includes an insulating housing 10, which has an internal compartment 13, a conductive stationary contact terminal 20 and a moving contact terminal 30, which are fixed to the housing 10, and an operating unit 50. As shown in FIG. 2, the switch 1 includes a conductive moving contact unit 40, which is housed in the compartment 13, a first elastic unit 70, which is housed in the compartment 13 and fixed to the housing 10, and a second elastic unit 80, which is housed in the compartment 13 and fixed to the stationary contact terminal 20. The operating unit 50 is at least partly exposed outside the housing 10 and at least partly housed in the compartment 13.

As shown in FIG. 1, the housing 10 includes a substantially rectangular base 11 and a substantially rectangular cover 12 covering a first rectangular surface 111, which is one of a pair of surfaces facing each other in the thickness direction of the base 11 (the vertical direction in FIG. 1). In other words, the compartment 13 is defined by the first rectangular surface 111 of the base 11 and the cover 12.

The base 11 has a first end 113 in its longitudinal direction (X-direction in FIG. 2) on which the moving contact terminal 30 is fixed, and a second end 114 in its longitudinal direction on which an auxiliary terminal 60 is fixed. The base 11 has the stationary contact terminal 20 fixed between the moving contact terminal 30 and the auxiliary terminal 60 in the longitudinal direction of the base 11. The stationary contact terminal 20, the moving contact terminal 30, and the auxiliary terminal 60 are arranged side by side in the longitudinal direction of the base 11, and are fixed to the base 11 in a manner electrically independent of one another.

The cover 12 has a substantially rectangular operating slot 14 in its surface facing the first rectangular surface 111 of the base 11 (the upper surface in FIG. 1), through which the operating unit 50 is insertable. This operating slot 14 extends through the cover 12 in the thickness direction of the base 11 (Z-direction in FIG. 2).

As shown in FIG. 2, the stationary contact terminal 20 includes a terminal segment 21, which is a plate extending from outside the housing 10 to the compartment 13 of the housing 10, and a fixed portion 22, which is connected to the terminal segment 21 and housed in the compartment 13.

The terminal segment 21 has its plate surface intersecting with the lateral direction of the base 11, and extends, in the thickness direction of the base 11, from outside the housing 10 to a second rectangular surface 112 facing the first rectangular surface 111.

Figure 3:
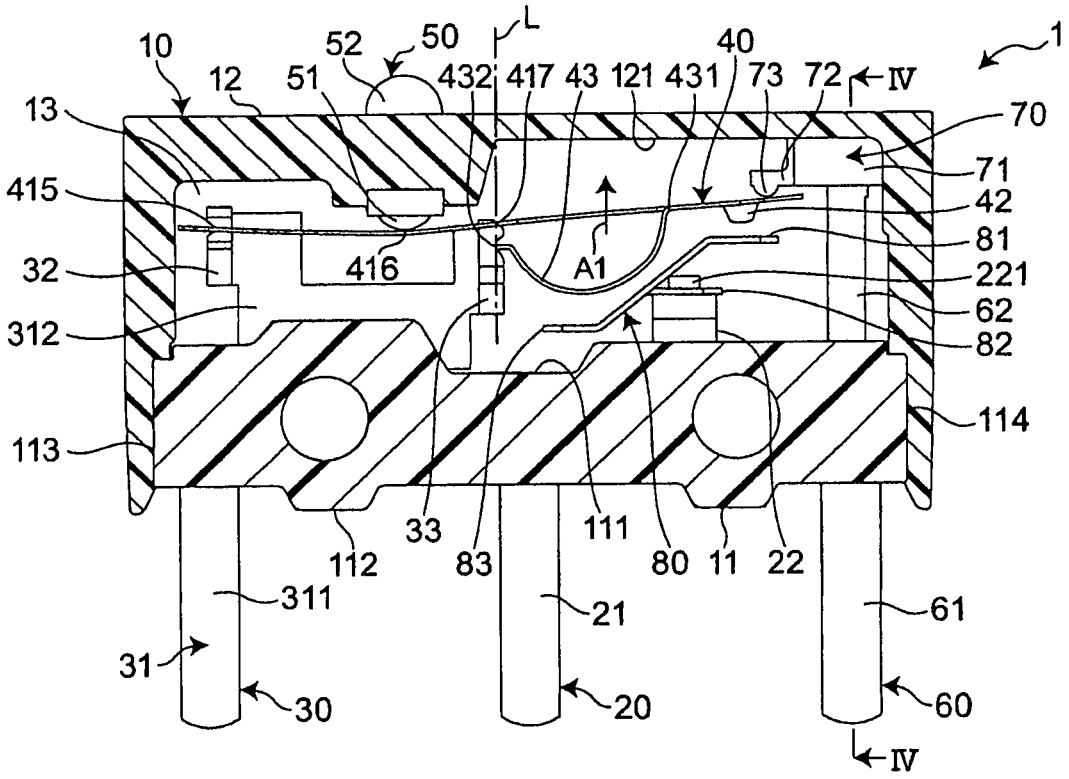
FIG. 3 is a cross-sectional view taken along line in FIG. 1 describing the operation of the switch shown in FIG. 1.

The fixed portion 22 is substantially rectangular as viewed from above in the thickness direction of the base 11, and is arranged on an end of the terminal segment 21 adjacent to the compartment 13. As shown in FIG. 3, the fixed portion 22 has a substantially cylindrical protrusion 221 for fixing the second elastic unit 80 on its upper surface facing the cover 12.

As shown in FIG. 2, the moving contact terminal 30 includes a terminal segment 31, which is a plate extending from outside the housing 10 to the compartment 13 of the housing 10, and a first wall 32 and a second wall 33, each of which is connected to an end of the terminal segment 31 adjacent to the compartment 13 and housed in the compartment 13.

The terminal segment 31 has its plate surface intersecting with the lateral direction of the base 11. As shown in FIG. 3, the terminal segment 31 includes a first terminal segment 311, which extends from outside the housing 10 to the second rectangular surface 112 in the thickness direction of the base 11, and a second terminal segment 312, which is connected to an end of the first terminal segment 311 adjacent to the compartment 13 and extends in the longitudinal direction of the base 11 along the first rectangular surface 111 adjacent to the compartment 13.

The first wall 32 is arranged on an end of the second terminal segment 312 nearer the first end 113 of the base 11 (the left end in FIG. 3), and extends in the lateral direction of the base 11. This first wall 32 has a body 41 of the moving contact unit 40 (described later) connected to it. The second wall 33 is arranged on an end of the second terminal segment 312 nearer the second end 114 of the base 11 (the right end in FIG. 3), and extends in the lateral direction of the base 11. This second wall 33 has a plate spring 43 of the moving contact unit 40 (described later) connected to it.

As shown in FIG. 2, the moving contact unit 40 includes the body 41, a moving portion 42 located on the body 41, and the plate spring 43, which is one example of an urging member. In the first embodiment, the moving portion 42 is formed from a metal, and serves as a moving contact. The moving portion 42 may not be formed from a metal, and may be formed from any other conductive material.

As shown in FIG. 2, the body 41 extends in a direction in which the stationary contact terminal 20 and the moving contact terminal 30 are arranged parallel to each other (the longitudinal direction of the base 11), and has one end in the longitudinal direction connected to the first wall 32 of the moving contact terminal 30.

More specifically, the body 41 is a plate elastically deformable in the thickness direction of the base 11. The body 41 includes a substantially rectangular first through-hole 411 and a substantially rectangular second through-hole 412. The first through-hole 411 and the second through-hole 412 extend through the body 41 in the thickness direction, and are spaced from each other in the longitudinal direction of the base 11. The first through-hole 411 receives the first wall 32, and has an end nearer the first end 113 of the base 11 being a connecting portion 415 of the body 41 for the first wall 32 of the moving contact terminal 30.

As shown in FIG. 2, the moving portion 42 is located on a distal end of the body 41 (an end of the body 41 nearer the second end 114 of the base 11), and faces the fixed portion 22 in a manner movable in the directions toward the fixed portion 22 (downward in Z-direction in FIG. 2) and away from the fixed portion 22 (upward in Z-direction in FIG. 2).

This moving portion 42 does not directly come in contact with the fixed portion 22, and is electrically connected to the fixed portion 22 through a contact point 81 of the second elastic unit 80 (described later).

As shown in FIG. 2, the plate spring 43 is located nearer the moving portion 42 than the center of the body 41 in the longitudinal direction to urge the moving portion 42. The plate spring 43 can switch the direction of urging the moving portion 42 between the closing direction for allowing the moving portion 42 to move toward the fixed portion 22 and the separating direction for moving the moving portion 42 away from the fixed portion 22.

More specifically, the plate spring 43 is curved (in an arc) to protrude toward the base 11 from the body 41, in the longitudinal direction of the base 11, and extends to the second wall 33 of the moving contact terminal 30 from a first end 431 of the second through-hole 412 of the body 41 nearer the second end 114 of the base 11 in the longitudinal direction of the base 11. As shown in FIG. 3, the second end 432 of the plate spring 43, which is nearer the first end 113 of the base 11, is connected to the second wall 33 at a position nearer the base 11 than the connecting portion 415 on the first wall 32 of the body 41 in the thickness direction of the base 11.

The plate spring 43 operates in the manner described below (described in detail later). When the body 41 of the moving contact unit 40 away from the fixed portion 22 moves toward the fixed portion 22 until the body 41 exceeds a predetermined position (the urging direction switching position) toward the base 11 in the thickness direction of the base 11, the plate spring 43 switches the direction of urging the moving portion 42 from the separating direction to the closing direction. When the moving portion 42 in contact with the fixed portion 22 moves away from the fixed portion 22 and the body 41 exceeds the predetermined position toward the cover 12 in the thickness direction of the base 11, the plate spring 43 switches the direction of urging the moving portion 42 from the closing direction to the separating direction.

The switch 1 includes the body 41, the moving portion 42, and the plate spring 43 that are integral with one another.

As shown in FIG. 2, the operating unit 50 is substantially rectangular and extends in the lateral direction of the base 11. As shown in FIG. 3, the operating unit 50 has a lower end 51 in the thickness direction of the base 11 in contact with the body 41 of the moving contact unit 40 between the first through-hole 411 and the second through-hole 412, and has an upper end 52 in the thickness direction of the base 11 exposed outside the housing 10 through the operating slot 14 of the cover 12. The operating unit 50 is reciprocally movable in the thickness direction of the base 11.

As shown in FIG. 2, the auxiliary terminal 60 includes a terminal segment 61, which is a plate extending from outside the housing 10 to the compartment 13 of the housing 10, and a support 62, which is connected to an end of the terminal segment 61 adjacent to the compartment 13 and housed in the compartment 13.

The terminal segment 61 has its plate surface intersecting with the lateral direction of the base 11. The terminal segment 61 extends from outside the housing 10 to the second rectangular surface 112 in the thickness direction of the base 11. The support 62 is connected to an end of the terminal segment 61 adjacent to the compartment 13 in the thickness direction of the base 11, and protrudes towards the cover 12 from the first rectangular surface 111 of the base 11 in the thickness direction of the base 11.

The first elastic unit 70 is fixed to the housing 10, and comes in contact with the moving contact unit 40 and elastically deforms in the separating direction when the moving portion 42 moves away from the fixed portion 22 under the urging force of the plate spring 43.

Figure 5:
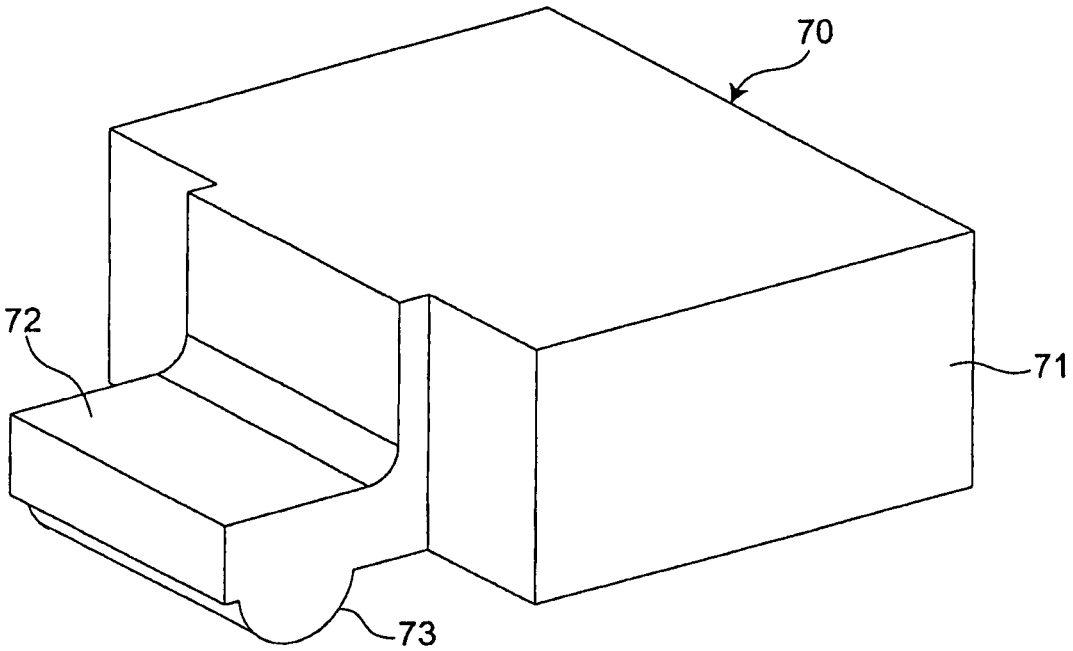
FIG. 5 is a perspective view of a first elastic unit in the switch shown in FIG. 1.

More specifically, the first elastic unit 70 is formed from an elastic material such as rubber. As shown in FIG. 5, the first elastic unit 70 includes a substantially rectangular elastic body 71, and a tab 72 protruding from one side surface of the elastic body 71 extending in the longitudinal direction in the direction perpendicular to this side surface.

Figure 4:
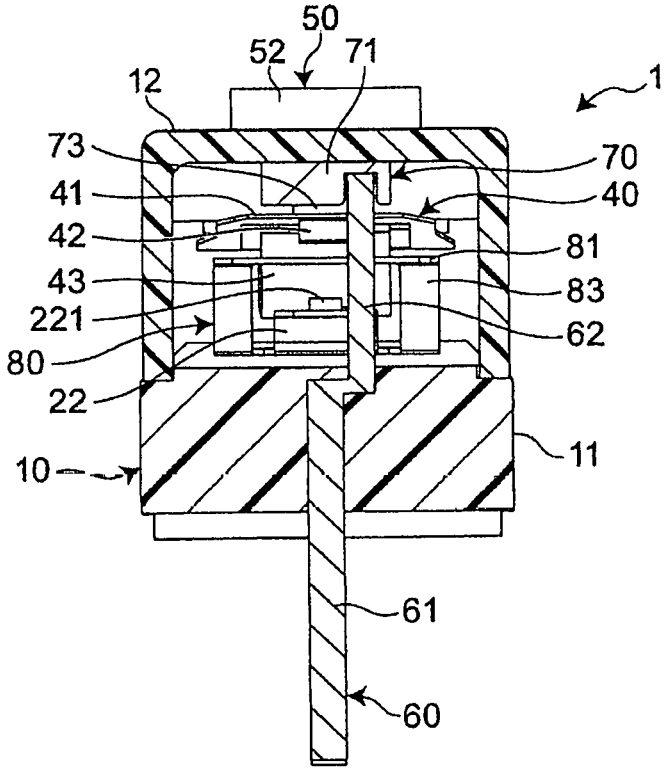
FIG. 4 is a cross-sectional view taken along line IV-IV in FIG. 3.

As shown in FIG. 4, the elastic body 71 is fixed to a distal end of the support 62 of the auxiliary terminal 60 (an end adjacent to the cover 12 in the thickness direction of the base 11). In other words, the first elastic unit 70 is fixed to the housing 10 with the support 62. The tab 72 includes a protrusion 73 on the surface of its distal end facing the moving contact unit 40 (an end away from the elastic body 71). As shown in FIG. 5, the protrusion 73 is a substantially semicircular column. As shown in FIG. 3, the protrusion 73 protrudes from the surface of the tab 72 facing the moving contact unit 40 in the closing direction toward the moving contact unit 40 (downward in FIG. 3), and has its distal end in contact with the moving contact unit 40 when the moving portion 42 moves away from the fixed portion 22 under the urging force of the plate spring 43.

The second elastic unit 80 is formed from a conductive material. As shown in FIG. 3, the second elastic unit 80 includes the contact point 81 arranged between the moving portion 42 and the fixed portion 22 in the closing direction (downward in FIG. 3). The contact point 81 faces the moving portion 42 and is contactable with the moving portion 42. The second elastic unit 80 is fixed to the stationary contact terminal 20. The second elastic unit 80 elastically deforms in the closing direction and electrically connects the stationary contact terminal 20 and the moving contact terminal 30 when the moving portion 42 moves toward the fixed portion 22 under the urging force of the plate spring 43 and then comes in contact with the contact point 81.

Figure 6:
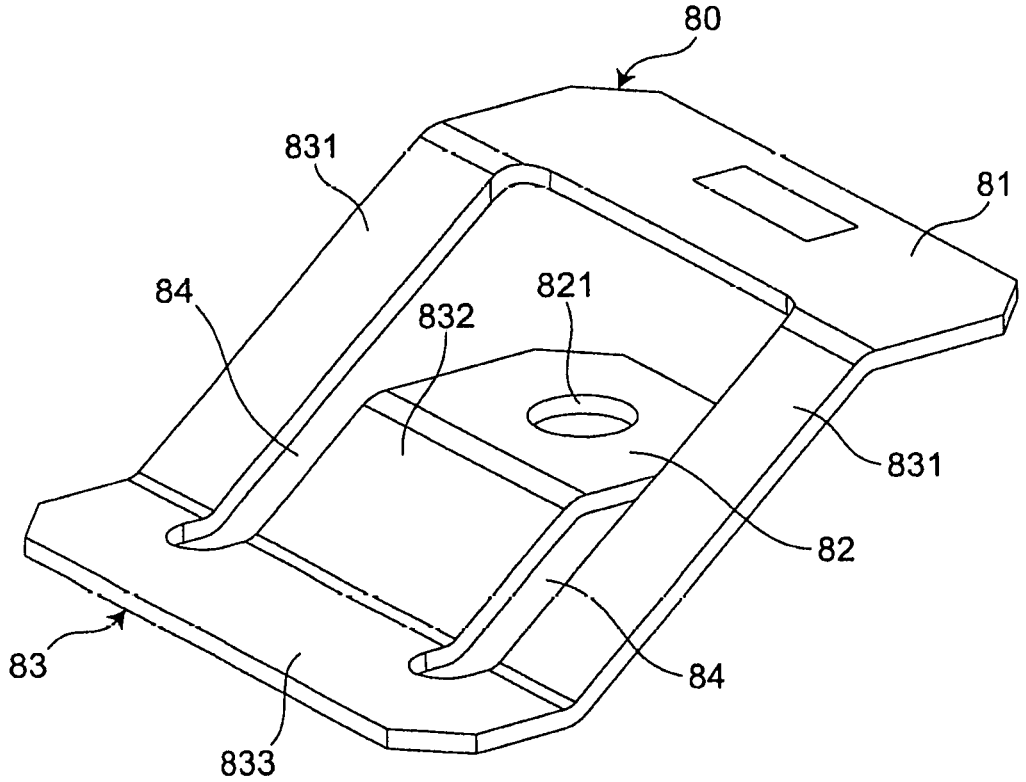
FIG. 6 is a perspective view of a second elastic unit in the switch shown in FIG. 1.

More specifically, as shown in FIG. 6, the second elastic unit 80 includes the contact point 81, which is a substantially rectangular plate, a base portion 82, which is fixed to the stationary contact terminal 20, and a connecting portion 83, which is connected to the contact point 81 and the base portion 82. In the first embodiment, the second elastic unit 80 is formed from a metal, and the contact point 81 serves as a metallic stationary contact.

The base portion 82 is a substantially rectangular plate. The base portion 82 includes a substantially circular through-hole 821, in which the protrusion 221 of the fixed portion 22 can be fit. As shown in FIG. 3, the base portion 82 is located nearer the base 11 than the contact point 81 in the thickness direction of the base 11. The through-hole 821 receives the protrusion 221 of the fixed portion 22 to fix the second elastic unit 80 to the stationary contact terminal 20. As shown in FIG. 6, the base portion 82 has its side surfaces extending in the longitudinal direction substantially parallel to the side surfaces of the contact point 81 extending in the longitudinal direction.

The connecting portion 83 includes a pair of first connecting portions 831, which are connected to the contact point 81, a second connecting portion 832, which is connected to the base portion 82, and an intermediate portion 833, which is connected to the pair of first connecting portions 831 and the second connecting portion 832. As shown in FIG. 3, the intermediate portion 833 is located to have the base portion 82 between the contact point 81 and the intermediate portion 833 in the longitudinal direction of the base 11. The intermediate portion 833 is located nearer the base 11 than the base portion 82 in the thickness direction of the base 11. In other words, the second elastic unit 80 has the base portion 82 between the contact point 81 and the intermediate portion 833 in the thickness direction of the base 11.

The first connecting portions 831 extend from the two ends of one longer side of the contact point 81 nearer the intermediate portion 833. The first connecting portions 831 slope toward the base 11 in the direction intersecting with the direction in which the moving portion 42 moves toward or away from the fixed portion 22. The second connecting portion 832 extends from one longer side of the base portion 82 nearer the intermediate portion 833, and slopes in the same direction as the first connecting portions 831. The two first connecting portions 831 and the second connecting portion 832 have clearances 84 between them to allow the connecting portion 83 to elastically deform in the closing direction when the moving portion 42 moves toward the fixed portion 22 under the urging force of the plate spring 43 and comes in contact with the contact point 81.

The operation of the switch 1 will now be described with reference to FIGS. 3, 4, and 7 to 10.

In FIGS. 3 and 4, the switch 1 is in a return state with no external force applied to the operating unit 50. In this state, the moving contact unit 40 has its moving portion 42 at a return position away from the fixed portion 22, and is in contact with the protrusion 73 of the first elastic unit 70 at its surface facing an inner surface 121 of the cover 12.

In this state, the body 41 of the moving contact unit 40 has an end nearer the second through-hole 412 in the longitudinal direction of the base 11 urged by the plate spring 43 in a first direction A1 (shown in FIG. 3) away from the first rectangular surface 111 of the base 11 in the thickness direction of the base 11 (the vertical direction in FIGS. 3 and 4). The moving contact unit 40 also has the moving portion 42 that is urged in the first direction A1. The body 41 also includes an intermediate portion 417, which intersects with an imaginary line extending in the thickness direction of the base 11 through the second end 432 of the plate spring 43 as viewed in the lateral direction of the base 11. The intermediate portion 417 is located above the second end 432 of the plate spring 43 (nearer the cover 12 than the second end 432 of the plate spring 43 in the thickness direction of the base 11).

When an external force is applied to the upper end 52 of the operating unit 50 to press the operating unit 50 in a second direction A2 (shown in FIG. 7) toward the base 11 in the thickness direction of the base 11, a portion of the body 41 of the moving contact unit 40 around a contact point 416 in contact with the lower end 51 of the operating unit 50 deforms elastically in the second direction A2. This moves the intermediate portion 417 toward the second end 432 of the plate spring 43.

Figure 7:
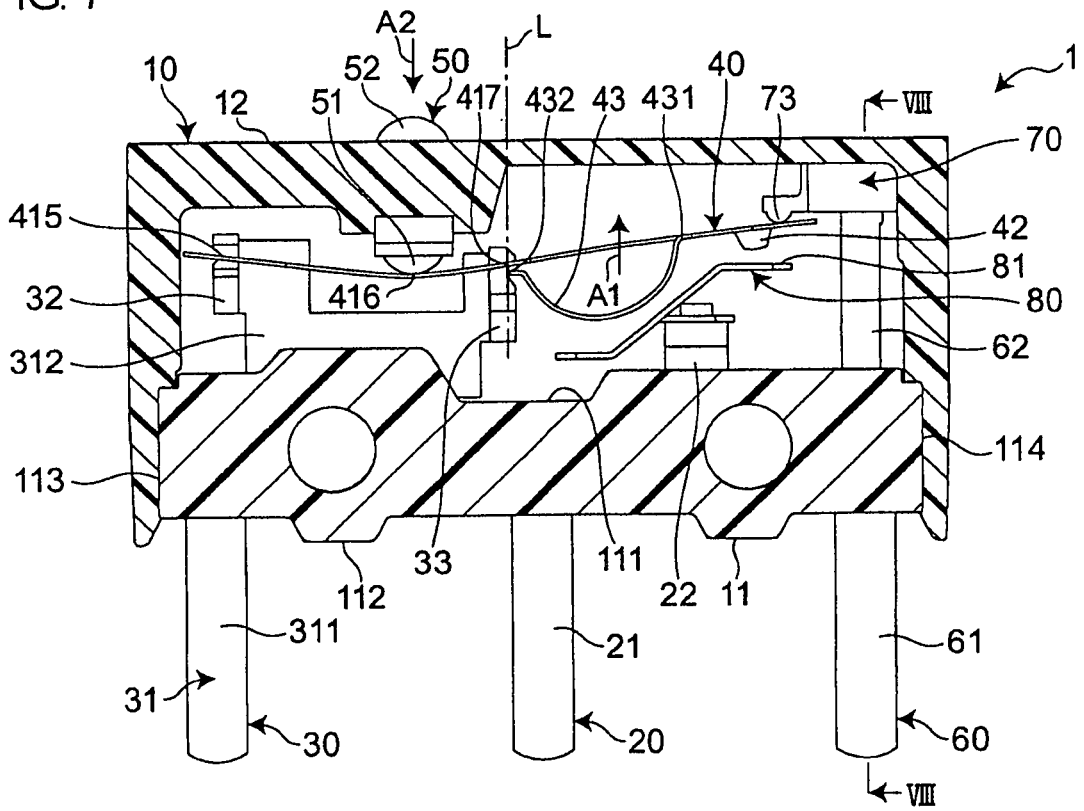
FIG. 7 is a cross-sectional view taken along line III-III in FIG. 1 describing the operation of the switch shown in FIG. 1, continuous from the operation shown in FIG. 3.
Figure 8:
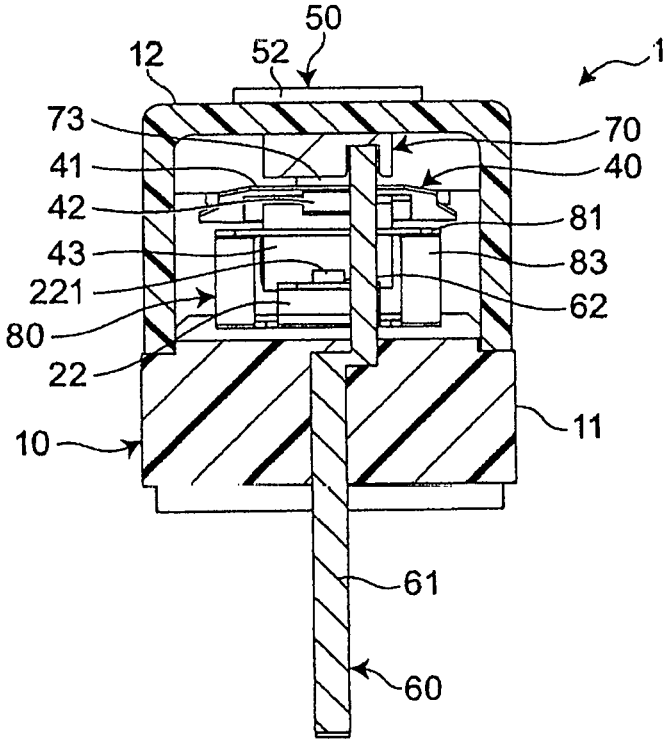
FIG. 8 is a cross-sectional view taken along line VIII-VIII in FIG. 7.

In this state, the urging force applied to the body 41 of the plate spring 43 decreases as the intermediate portion 417 moves toward the second end 432 of the plate spring 43. As shown in FIGS. 7 and 8, no urging force is applied at a position at which the intermediate portion 417 and the second end 432 of the plate spring 43 overlap each other (the urging direction switching position) as viewed in the lateral direction of the base 11 (the horizontal direction in FIG. 8).

Figure 9:
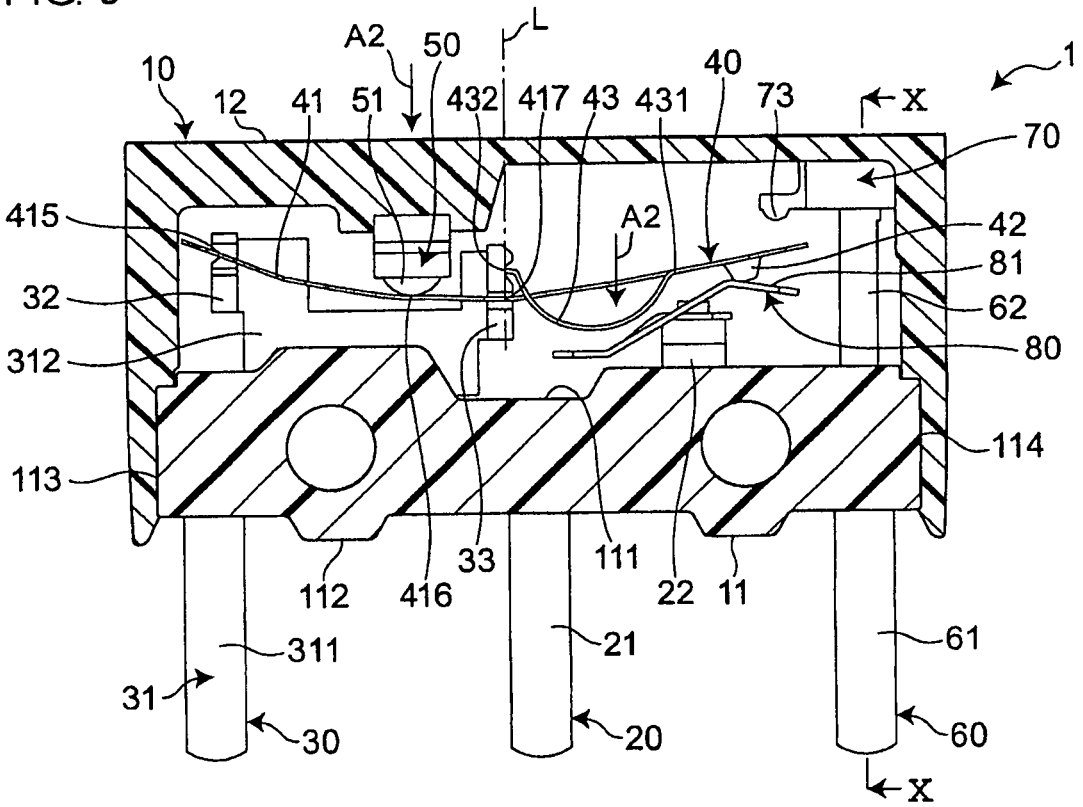
FIG. 9 is a cross-sectional view taken along line in FIG. 1 describing the operation of the switch shown in FIG. 1, continuous from the operation shown in FIG. 7.
Figure 10:
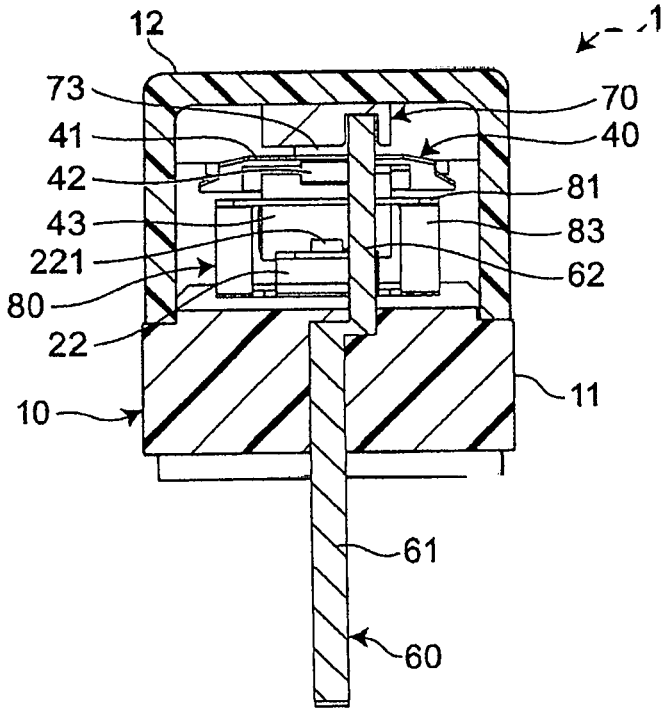
FIG. 10 is a cross-sectional view taken along line X-X in FIG. 9.

When the operating unit 50 is pressed in the second direction A2 further, a portion of the body 41 of the moving contact unit 40 around a contact point 416 in contact with the lower end 51 of the operating unit 50 deforms elastically in the second direction A2 further. This moves the intermediate portion 417 toward the base 11 beyond the second end 432 of the plate spring 43 as shown in FIGS. 9 and 10.

When the intermediate portion 417 moves toward the base 11 beyond the second end 432 of the plate spring 43, the direction of the urging force applied to the body 41 of the plate spring 43 (the direction of urging the moving portion 42) switches from the first direction A1 (separating direction) to the second direction A2 (closing direction). This quickly moves the moving portion 42, which is a moving contact, in the second direction A2 to an activating position at which the moving portion 42 is in contact with the contact point 81 of the second elastic unit 80, which is a stationary contact. This activates the switch 1.

Subsequently, the pressing of the operating unit 50 in the second direction A2 is released. The elastically deformed body 41 of the moving contact unit 40, together with the operating unit 50, returns from the activating position shown in FIGS. 9 and 10 to the return position shown in FIGS. 3 and 4.

The returning force of the body 41 moves the intermediate portion 417 located below the second end 432 of the plate spring 43 (nearer the base 11 than the second end 432 of the plate spring 43 in the thickness direction of the base 11) in the first direction A1 beyond the second end 432 of the plate spring 43 toward the cover 12. The urging force applied to the body 41 of the plate spring 43 (the direction of urging the moving portion 42) switches from the second direction A2 (closing direction) to the first direction A1 (separating direction). This quickly moves the moving portion 42, which is a moving contact, in the first direction A1 to the return position away from the contact point 81, which is a stationary contact. This deactivates the switch 1.

In other words, when the moving portion 42 moves toward or away from the fixed portion 22 and the intermediate portion 417 of the body 41 passes beyond the urging direction switching position at which the intermediate portion 417 and the second end 432 of the plate spring 43 overlap each other, the direction of urging the moving portion 42 of the plate spring 43 switches from the separating direction to the closing direction or from the closing direction to the separating direction.

When the moving portion 42 moves away from the fixed portion 22 and moves to the return position, the protrusion 73 of the first elastic unit 70 comes in contact with the surface of the moving contact unit 40 facing the inner surface 121 of the cover 12 as shown in FIGS. 3 and 4. The tab 72 thus elastically deforms in the direction away from the body 41.

The above switch 1 includes the first elastic unit 70, which comes in contact with the moving contact unit 40 and elastically deforms in the separating direction when the moving portion 42 moves away from the fixed portion 22 under the urging force of the plate spring 43, and also includes the second elastic unit 80, which elastically deforms in the closing direction and electrically connects the stationary contact terminal 20 and the moving contact terminal 30 when the moving portion 42 moves toward the fixed portion 22 under the urging force of the plate spring 43 and comes in contact with the contact point 81. This structure reduces an impact applied when the moving portion 42 moves away from the contact point 81 of the second elastic unit 80, in addition to reducing an impact applied when the moving portion 42 comes in contact with the contact point 81 of the second elastic unit 80. This reduces sounds from such impacts applied when the moving portion 42 moves toward or away from the fixed portion 22. The switch 1 is thus quieter.

Figure 11:
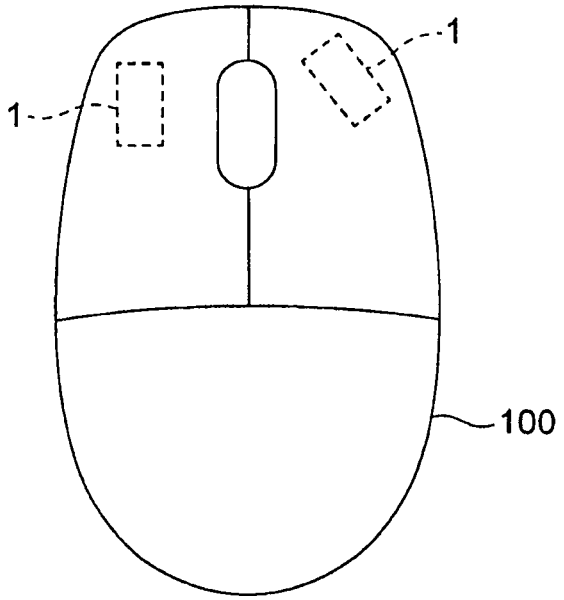
FIG. 11 is a top view of a mouse including the switch shown in FIG. 1.

When, for example, the switch 1 is used for a click button of a mouse 100 as shown in FIG. 11, the mouse 100 has a click sound smaller by at least about 60% than a sound that may be produced by a switch including a moving contact that collides with a stationary contact in the direction of contact.

The moving portion 42 faces the fixed portion 22 and is movable toward and away from the fixed portion 22 (the moving portion 42 as a moving contact faces the contact point 81 of the second elastic unit 80 and is movable toward and away from the contact point 81 of the second elastic unit 80 as a stationary contact). This switch is more durable than a switch including a moving contact that slides on a stationary contact.

The second elastic unit 80 includes the base portion 82, which is fixed to the stationary contact terminal 20, and the connecting portion 83, which is connected to the contact point 81 and the base portion 82 and slopes in the direction intersecting with the separating direction and the closing direction. The contact point 81 serves as a stationary contact. The moving portion 42 serves as a moving contact. The connecting portion 83 elastically deforms in the closing direction when the moving portion 42, which is a moving contact, moves toward the fixed portion 22 under the urging force of the plate spring 43 and comes in contact with the contact point 81, which is a stationary contact. This structure may reduce sounds from impacts applied when the moving portion 42, which is a moving contact, collides with the contact point 81 of the second elastic unit 80, which is a stationary contact. The switch 1 is thus quieter.

The first elastic unit 70 includes the protrusion 73, which protrudes in the closing direction and has its distal end in contact with the moving contact unit 40 when the moving portion 42 moves away from the fixed portion 22 under the urging force of the plate spring 43. This structure allows the first elastic unit 70 to come in contact with the moving contact unit 40 in a more reliable manner. This structure reduces sounds from impacts applied when the moving portion 42 moves away from the contact point 81 of the second elastic unit 80. The switch is thus quieter.

The first elastic unit 70 may be fixed to the housing 10, and may not be fixed to the distal end of the support 62 of the auxiliary terminal 60. For example, the first elastic unit 70 may be integral with the cover 12. In this case, the auxiliary terminal 60 may be eliminated.

The body 41, the moving portion 42, and the plate spring 43 included in the moving contact unit 40 may not be integral with one another and may be separate from one another. For example, the plate spring 43 may be replaced with a coil spring that serves as an urging member. In other words, one or more embodiments of the present invention may not be the above switch 1, but may be a switch with any structure including a first elastic unit that comes in contact with a moving contact unit and elastically deforms in the separating direction when a moving portion moves away from a fixed portion under the urging force of an urging member and a second elastic unit that elastically deforms in the closing direction and electrically connects a stationary contact terminal and a moving contact terminal when the moving portion moves toward the fixed portion under the urging force of the urging member and comes in contact with a contact point.

Second Embodiment

Figure 12:
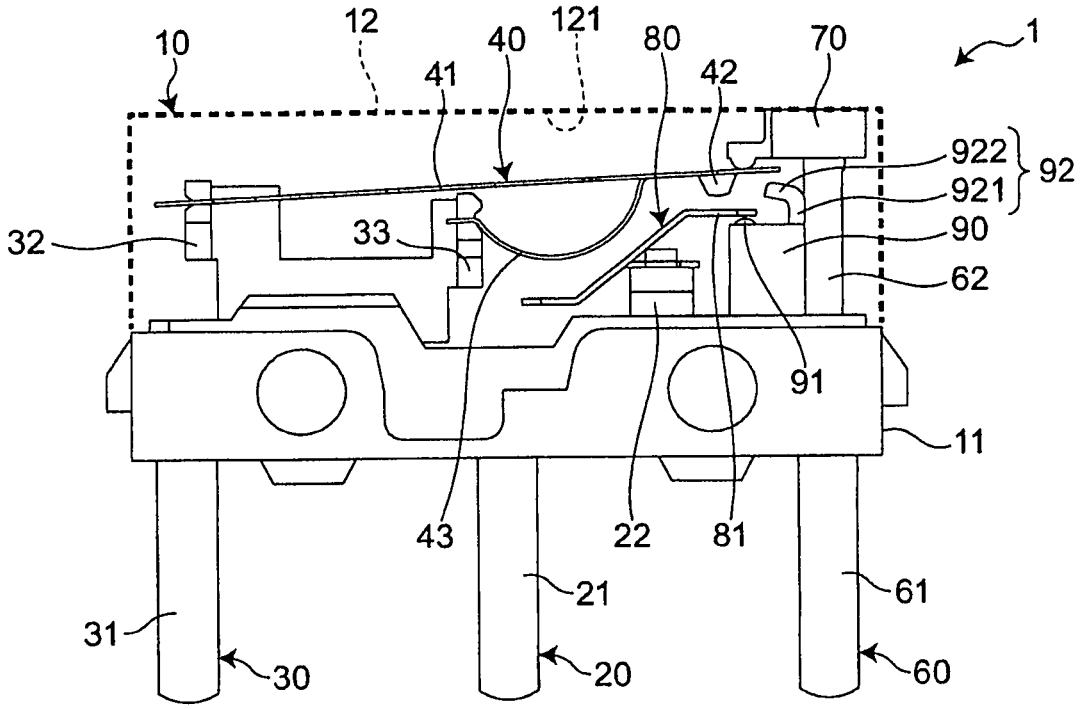
FIG. 12 is a side view of a switch according to one or more embodiments of the present invention with its cover and operating unit removed.

As shown in FIG. 12, a switch 1 according to a second embodiment of the present invention differs from the switch in the first embodiment in additionally including a third elastic unit 90. The third elastic unit 90 comes in contact with a body 41 of a moving contact unit 40 and a contact point 81 after a moving portion 42 moves toward a fixed portion 22 under the urging force of a plate spring 43 and comes in contact with a contact point 81 of a second elastic unit 80.

The components in the second embodiment that are the same as in the first embodiment are given the same reference numerals, and will not be described. The components in the second embodiment different from those in the first embodiment will be described. FIG. 12 does not show the operating unit 50.

As shown in FIG. 12, the third elastic unit 90, which is formed from an elastic material such as rubber, is substantially rectangular and is arranged between the support 62 of the auxiliary terminal 60 and the fixed portion 22 and is adjacent to the support 62. The third elastic unit 90 has an elastic protrusion 91 and an elastic arm 92 on its surface facing the inner surface 121 of the cover 12.

The elastic protrusion 91 is arranged on an end of the upper surface of the third elastic unit 90 nearer the fixed portion 22 in the longitudinal direction of the base 11, and faces an end of the contact point 81 of the second elastic unit 80 nearer the auxiliary terminal 60 in the thickness direction of the base 11. In other words, the elastic protrusion 91 comes in contact with the contact point 81 and elastically deforms in the closing direction in which the moving portion 42 moves toward the fixed portion 22 (downward in FIG. 12) after the moving portion 42 moves toward the fixed portion 22 under the urging force of the plate spring 43 and comes in contact with the contact point 81 of the second elastic unit 80.

The elastic arm 92 includes a vertical member 921, which extends along the support 62, and a horizontal member 922, which extends from the vertical member 921 toward the fixed portion 22 in the longitudinal direction of the base 11. The elastic arm 92 is arranged adjacent to the support 62 of the auxiliary terminal 60 in the longitudinal direction of the base 11. The horizontal member 922 may be elastically deformable in the thickness direction of the base 11, and has its distal end facing an end of the body 41 of the moving contact unit 40 nearer the auxiliary terminal 60 in the thickness direction of the base 11. In other words, the elastic arm 92 comes in contact with the body 41 of the moving contact unit 40 and elastically deforms in the closing direction in which the moving portion 42 moves toward the fixed portion 22 (downward in FIG. 12) after the moving portion 42 moves toward the fixed portion 22 under the urging force of the plate spring 43 and comes in contact with the contact point 81 of the second elastic unit 80.

The third elastic unit 90 arranged in this manner can reduce the force that acts in the closing direction when the moving portion 42, which is a moving contact, comes in contact with the contact point 81 of the second elastic unit 80, which is a stationary contact. This structure reduces sounds from impacts applied when the moving portion 42 moves toward the fixed portion 22. The switch is thus quieter.

Third Embodiment

Figure 13:
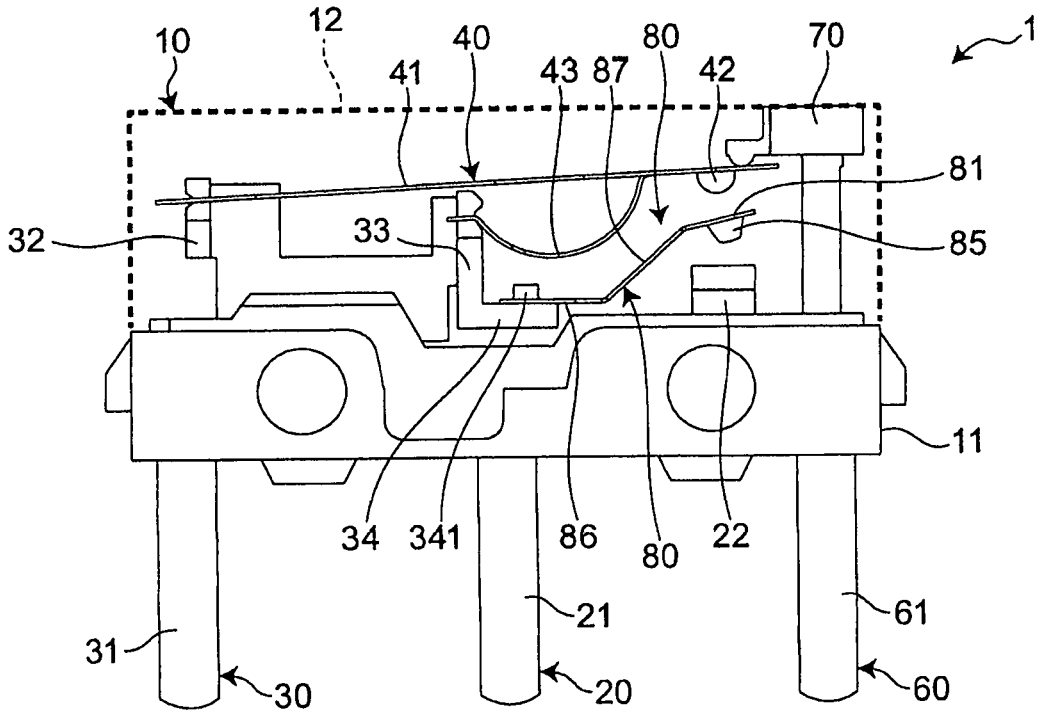
FIG. 13 is a side view of a switch according to one or more d embodiments of the present invention with its cover and operating unit removed.

As shown in FIG. 13, a switch 1 according to a third embodiment of the present invention differs from the switch in the first embodiment in that a moving portion 42 is formed from an elastic material, a second elastic unit 80 is fixed to a moving contact terminal 30, and a contact point 81 has a moving contact 85 on its surface facing a fixed portion 22.

The components in the third embodiment that are the same as in the first embodiment are given the same reference numerals, and will not be described. The components in the third embodiment different from those in the first embodiment will be described. FIG. 13 does not show the operating unit 50.

As shown in FIG. 13, the moving contact terminal 30 has a third wall 34, which is connected to an end of the second wall 33 near the base 11 in the thickness direction of the base 11 (the vertical direction in FIG. 13). The third wall 34 extends in the longitudinal direction of the base 11, and includes a protrusion 341 on its upper surface facing the cover 12 in the thickness direction of the base 11.

The elastic material forming the moving portion 42 may be either conductive or non-conductive.

The second elastic unit 80 includes the contact point 81, which is a substantially rectangular plate facing the moving portion 42, a base portion 86, which is a substantially rectangular plate fixed to the third wall 34 of the moving contact terminal 30, and a connecting portion 87, which is a substantially rectangular plate connecting the contact point 81 and the base portion 86.

The base portion 86 has a through-hole (not shown), in which the protrusion 341 of the third wall 34 can be fit. The through-hole receives the protrusion 341 of the third wall 34 to fix the second elastic unit 80 to the moving contact terminal 30. The base portion 86 has its side surfaces extending in the longitudinal direction substantially parallel to the side surfaces of the contact point 81 extending in the longitudinal direction.

The connecting portion 87 is connected to the side surfaces of the contact point 81 and the base portion 86 facing each other and extending in the longitudinal direction. The connecting portion 87 intersects with the direction in which the moving portion 42 moves toward or away from the fixed portion 22 (the vertical direction in FIG. 13), and slopes in the direction toward the base 11.

The moving contact 85 is formed from a metal, and comes in contact with the fixed portion 22, which is a stationary contact, after the moving portion 42 moves toward the fixed portion 22 under the urging force of the plate spring 43 and comes in contact with the contact point 81 of the second elastic unit 80. The moving contact 85 may not be formed from a metal, and may be formed from any other conductive material.

In this manner, the moving portion 42 is formed from an elastic material, and the second elastic unit 80 is fixed to the moving contact terminal 30, and the contact point 81 includes the moving contact 85 on its surface facing the fixed portion 22. This structure reduces sounds from impacts applied when the moving portion 42 comes in contact with the contact point 81 of the second elastic unit 80 and the moving contact 85 collides with the fixed portion 22, which is a stationary contact. The switch is thus quieter.

The embodiments of the present invention are described above in detail with reference to the drawings. The embodiments may be modified in various forms described below.

A switch according to a first aspect of the present invention includes a housing, a stationary contact terminal, a moving contact terminal, a moving contact unit, an operating unit, a first elastic unit, and a second elastic unit. The housing includes an internal compartment. The stationary contact terminal extends from outside the housing to the compartment and is fixed to the housing, and includes a fixed portion housed in the compartment. The moving contact terminal extends from outside the housing to the compartment, and is parallel to the stationary contact terminal. The moving contact terminal is fixed to the housing in a manner electrically independent of the stationary contact terminal. The moving contact unit is housed in the compartment, and includes a body, a moving portion, and an urging member. The body is connected to the moving contact terminal and extends from the moving contact terminal toward the stationary contact terminal. The moving portion is included in the body and faces the fixed portion and is movable toward and away from the fixed portion. The urging member is included in the body to urge the moving portion in an urging direction switchable between a closing direction for moving the moving portion toward the fixed portion and a separating direction for moving the moving portion away from the fixed portion. The operating unit is at least partly exposed outside the housing, and is at least partly housed in the compartment to come in contact with and reciprocate with respect to the moving contact unit. The operating unit switches the urging direction in accordance with reciprocation of the operating unit to move the moving portion toward or away from the fixed portion. The first elastic unit is fixed to the housing, and comes in contact with the moving contact unit and elastically deforms in the separating direction when the moving portion moves away from the fixed portion under an urging force of the urging member. The second elastic unit includes a contact point located between the moving portion and the fixed portion facing the moving portion in the closing direction and comes in contact with the moving portion. The second elastic unit is fixed to the stationary contact terminal or the moving contact terminal, and elastically deforms in the closing direction and electrically connects the stationary contact terminal and the moving contact terminal when the moving portion moves toward the fixed portion under the urging force of the urging member and comes in contact with the contact point.

The switch according to the first aspect may reduce an impact applied when the moving portion comes in contact with the contact point of the second elastic unit in addition to an impact applied when the moving portion moves away from the contact point of the second elastic unit. This reduces sounds from such impacts applied when the moving portion moves toward or away from the fixed portion. The switch is thus quieter.

The moving portion faces the fixed portion and is movable toward and away from the fixed portion. The switch with this structure is more durable than a switch including a moving portion that slides on a fixed portion.

In a switch according to a second aspect of the present invention, the second elastic unit includes a base portion and a connecting portion. The base portion is fixed to the stationary contact terminal. The connecting portion is connected to the contact point and the base portion and slopes in a direction intersecting with the closing direction and the separating direction. The contact point includes a stationary contact, and the moving portion includes a moving contact. The connecting portion elastically deforms in the closing direction when the moving contact moves toward the fixed portion under the urging force of the urging member and comes in contact with the stationary contact.

The switch according to the second aspect may reduce sounds from impacts applied when the moving portion, which is a moving contact, collides with the contact point of the second elastic unit, which is a stationary contact. The switch is thus quieter.

In a switch according to a third aspect of the present invention, the moving portion includes an elastic material. The fixed portion includes a stationary contact. The second elastic unit includes a base portion, a connecting portion, and a moving contact. The base portion is fixed to the moving contact terminal. The connecting portion is connected to the contact point and the base portion and slopes in a direction intersecting with the closing direction and the separating direction. The moving contact is located on a portion facing the fixed portion of the contact point, and comes in contact with the stationary contact in accordance with movement of the moving portion toward the fixed portion.

The switch according to the third aspect may reduce sounds from impacts applied when the moving portion comes in contact with the contact point of the second elastic unit and the moving contact collides with the fixed portion, which is a stationary contact, in a more reliable manner. The switch is thus quieter.

In a switch according to a fourth aspect of the present invention, the first elastic unit includes a protrusion protruding in the closing direction and having a distal end that comes in contact with the moving contact unit when the moving portion moves away from the fixed portion under the urging force of the urging member.

The switch according to the fourth aspect allows the first elastic unit to come in contact with the moving contact unit in a reliable manner. This structure reduces sounds from impacts applied when the moving portion moves away from the fixed portion in a more reliable manner. The switch is thus quieter.

The switch according to a fifth aspect of the present invention further includes a third elastic unit located near the second elastic unit in the compartment. The third elastic unit includes an elastic protrusion and an elastic arm. The elastic protrusion is located between the fixed portion and the contact point in the closing direction and comes in contact with the contact point. The elastic arm is located between the moving portion and the contact point in the closing direction and comes in contact with the moving portion.

The switch according to the fifth aspect may reduce the force in the closing direction when the moving portion comes in contact with the contact point of the second elastic unit in a more reliable manner. This structure reduces sounds from impacts applied when the moving portion moves toward the fixed portion in a more reliable manner. The switch is thus quieter.

The embodiments or modifications described above may be combined with one another to produce their advantageous effects. One or more embodiments may be combined with other embodiments, one or more modifications may be combined with other modifications, or one or more embodiments may be combined with one or more modifications. The features of different embodiments or different modifications may also be combined.

INDUSTRIAL APPLICABILITY

The switch according to the embodiments of the present invention may be used in, for example, gaming mice.

REFERENCE SIGNS LIST

1 switch
10 housing
11 base
111 first rectangular surface
112 second rectangular surface
113 first end
114 second end
12 cover
121 inner surface
13 compartment
14 operating slot
20 stationary contact terminal
21 terminal segment
22 fixed portion
221 protrusion
30 moving contact terminal
31 terminal segment
311 first terminal segment
312 second terminal segment
32 first wall
33 second wall
34 third wall
341 protrusion
40 moving contact unit
41 body
411 first through-hole
412 second through-hole
415 connecting portion
416 contact point
417 intermediate portion
42 moving portion
43 plate spring
431 first end
432 second end
50 operating unit
51 lower end
52 upper end
60 auxiliary terminal
61 terminal segment
62 support
70 first elastic unit
71 elastic body
72 tab
73 protrusion
80 second elastic unit
81 contact point
82 base portion
821 through-hole
83 connecting portion
831 first connecting portion
832 second connecting portion
833 intermediate portion
84 clearance
85 moving contact
86 base portion
87 connecting portion
90 third elastic unit
91 elastic protrusion
92 elastic arm
921 vertical member
922 horizontal member
100 mouse Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A switch, comprising:

a housing including an internal compartment;

a stationary contact terminal extending from outside the housing to the compartment and fixed to the housing, and including a fixed portion housed in the compartment;

a moving contact terminal extending from outside the housing to the compartment, and being parallel to the stationary contact terminal, the moving contact terminal being fixed to the housing in a manner electrically independent of the stationary contact terminal;

a moving contact unit housed in the compartment, and including a body connected to the moving contact terminal and extending from the moving contact terminal toward the stationary contact terminal, a moving portion included in the body and facing the fixed portion and being movable toward and away from the fixed portion, and an urging member included in the body and being configured to urge the moving portion in an urging direction switchable between a closing direction for moving the moving portion toward the fixed portion and a separating direction for moving the moving portion away from the fixed portion;

an operating unit at least partly exposed outside the housing, and at least partly housed in the compartment to come in contact with and reciprocate with respect to the moving contact unit, the operating unit being configured to switch the urging direction in accordance with reciprocation of the operating unit to move the moving portion toward or away from the fixed portion;

a first elastic unit fixed to the housing, and configured to come in contact with the moving contact unit and elastically deform in the separating direction when the moving portion moves away from the fixed portion under an urging force of the urging member;

a second elastic unit including a contact point located between the moving portion and the fixed portion facing the moving portion in the closing direction and being configured to come in contact with the moving portion, the second elastic unit being fixed to the stationary contact terminal or the moving contact terminal and being configured to elastically deform in the closing direction and electrically connect the stationary contact terminal and the moving contact terminal when the moving portion moves toward the fixed portion under the urging force of the urging member and comes in contact with the contact point, and a third elastic unit located near the second elastic unit in the compartment, the third elastic unit including an elastic protrusion located between the fixed portion and the contact point in the closing direction and being configured to come in contact with the contact point, and an elastic arm located between the moving portion and the contact point in the closing direction and being configured to come in contact with the moving portion.

2. The switch according to claim 1, wherein the first elastic unit includes a protrusion protruding in the closing direction and having a distal end configured to come in contact with the moving contact unit when the moving portion moves away from the fixed portion under the urging force of the urging member.

3. The switch according to claim 1, wherein the second elastic unit includes a base portion fixed to the stationary contact terminal, and a connecting portion connected to the contact point and the base portion and sloping in a direction intersecting with the closing direction and the separating direction, the contact point includes a stationary contact, and the moving portion includes a moving contact, and the connecting portion elastically deforms in the closing direction when the moving contact moves toward the fixed portion under the urging force of the urging member and comes in contact with the stationary contact.

4. The switch according to claim 3, wherein the first elastic unit includes a protrusion protruding in the closing direction and having a distal end configured to come in contact with the moving contact unit when the moving portion moves away from the fixed portion under the urging force of the urging member.

5. The switch according to claim 1, wherein the moving portion comprises an elastic material, the fixed portion includes a stationary contact, and the second elastic unit includes a base portion fixed to the moving contact terminal, a connecting portion connected to the contact point and the base portion and sloping in a direction intersecting with the closing direction and the separating direction, and a moving contact located on a portion facing the fixed portion of the contact point, and configured to come in contact with the stationary contact in accordance with movement of the moving portion toward the fixed portion.

6. The switch according to claim 5, wherein the first elastic unit includes a protrusion protruding in the closing direction and having a distal end configured to come in contact with the moving contact unit when the moving portion moves away from the fixed portion under the urging force of the urging member.

* * * * *